US010016652B1

(12) United States Patent
Siebert et al.

(10) Patent No.: US 10,016,652 B1
(45) **Date of Patent: *Jul. 10, 2018**

(54) WORKSTATION APPARATUS AND METHOD WITH CONVERGING TREADMILLS

(71) Applicant: Brunswick Corporation, Lake Forest, IL (US)

(72) Inventors: Paul Brian Siebert, Chicago, IL (US); William Cesare Cesaroni, Glenview, IL (US); Morad Ghassemian, Oak Park, IL (US); Brian Young Lee, Glenview, IL (US); Christopher Justin Mayer, Chicago, IL (US)

(73) Assignee: Brunswick Corporation, Mettawa, IL (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/638,766

(22) Filed: Jun. 30, 2017

Related U.S. Application Data

(63) Continuation of application No. 15/180,505, filed on Jun. 13, 2016, now Pat. No. 9,737,138, which is a continuation-in-part of application No. 29/531,671, filed on Jun. 29, 2015, now Pat. No. Des. 770,576, and a continuation-in-part of application No. 29/531,675, filed on Jun. 29, 2015, now Pat. No. Des. 769,381, and a continuation-in-part of application No. 29/531,676, filed on Jun. 29, 2015, now Pat. No. Des. 769,989.

(60) Provisional application No. 62/185,897, filed on Jun. 29, 2015.

(51) Int. Cl.

| | |
|---|---|
| ***A63B 22/02*** | (2006.01) |
| ***A47B 13/02*** | (2006.01) |
| ***A47B 21/06*** | (2006.01) |

(52) U.S. Cl.
CPC ..... *A63B 22/02* (2013.01); *A47B 13/02* (2013.01); *A47B 21/06* (2013.01); *A63B 2225/093* (2013.01); *A63B 2225/10* (2013.01)

(58) Field of Classification Search
CPC ..... A47B 37/00; A47B 13/088; A63B 22/02; A63B 2225/093; A63B 2225/10; A63B 2225/102
See application file for complete search history.

(56) References Cited

U.S. PATENT DOCUMENTS

| | | | |
|---|---|---|---|
| 1,919,627 | A | 7/1933 | Fitzgerald |
| 4,646,655 | A | 3/1987 | Robolin |
| 5,484,362 | A | 1/1996 | Skowronski et al. |
| D406,621 | S | 3/1999 | Piaget |

(Continued)

OTHER PUBLICATIONS

InMovement BI Stride by InMovement dated no date given. Found online [May 2, 2016] https://www.inmovement.com/en/our-products/inmovement-treadmill-desks/inmovement-bistride#.

*Primary Examiner* — Sundhara Ganesan
(74) *Attorney, Agent, or Firm* — Andrus Intellectual Property Law, LLP

(57) ABSTRACT

A shared workstation apparatus with converging treadmills including treadmills with centerlines that are transversely oriented towards each other at an angle, which can for example be an acute angle. The shared workstation includes a frame, a first treadmill, a second treadmill, and at least one shared work surface located above the treadmills. The orientation of the treadmills and the shared work surface allows users to share work with each other across the shared work space.

13 Claims, 8 Drawing Sheets

(56) References Cited

U.S. PATENT DOCUMENTS

| | | | |
|---|---|---|---|
| D421,779 | S | 3/2000 | Piaget |
| 6,461,279 | B1 | 10/2002 | Kuo |
| 6,645,126 | B1 | 11/2003 | Martin |
| 6,808,475 | B2 | 10/2004 | Kehrbaum |
| 7,614,991 | B2 | 11/2009 | Fox |
| 7,686,742 | B2 | 3/2010 | Tischler et al. |
| 7,892,148 | B1 | 2/2011 | Stauffer et al. |
| 7,922,626 | B2 | 4/2011 | Larson |
| D683,802 | S | 6/2013 | Kee |
| D691,223 | S | 10/2013 | Hao |
| 2004/0214693 | A1 | 10/2004 | Piaget |
| 2005/0037898 | A1 | 2/2005 | Chang |
| 2008/0058169 | A1 | 3/2008 | Fox |
| 2009/0062072 | A1 | 3/2009 | Packham |
| 2013/0116092 | A1 | 5/2013 | Martinez |
| 2013/0231216 | A1 | 9/2013 | Hao |
| 2014/0073488 | A1 | 3/2014 | Wu |
| 2014/0076206 | A1 | 3/2014 | McCabe |
| 2014/0080678 | A1 | 3/2014 | Wu |
| 2014/0187383 | A1 | 7/2014 | Martin |
| 2014/0360413 | A1 | 12/2014 | Schenk et al. |

WORKSTATION APPARATUS AND METHOD WITH CONVERGING TREADMILLS

CROSS REFERENCE TO RELATED APPLICATIONS

This present application is a continuation of U.S. patent application Ser. No. 15/180,505, filed Jun. 13, 2016, which claims the benefit of and priority to U.S. Provisional Patent Application No. 62/185,897, filed Jun. 29, 2015, which is hereby incorporated by reference in entirety. This present application also claims the benefit of and priority to U.S. Design patent application Ser. No. 29/531,671, filed Jun. 29, 2015, now U.S. Pat. No. D770,576; U.S. Design patent application Ser. No. 29/531,675, filed Jun. 29, 2015, now U.S. Pat. No. D769,381; and U.S. Design patent application Ser. No. 29/531,676, filed Jun. 29, 2015, now U.S. Pat. No. D769,989; which are hereby incorporated by reference in entirety.

FIELD

The present disclosure relates to workstation apparatuses that include exercise apparatuses, specifically a workstation apparatus with converging treadmills.

BACKGROUND

The following U.S. patent is hereby incorporated in its entirety.

U.S. Pat. No. 5,484,362 discloses an exercise treadmill provided with a frame that includes molded plastic pulleys, an integral gear belt sprocket, an endless belt extending around the pulleys, and a motor operatively connected to the rear pulley to drive the belt. The pulleys are molded out of plastic and have a diameter of approximately nine inches. A mold and method for producing large diameter treadmill pulleys having an integrally molded sprocket are also disclosed. A deck underneath the running surface of the belt is supported by resilient members. A positive lateral belt tracking mechanism is used to correct the lateral position of the belt. A belt position sensor mechanism is used in combination with a front pulley pivoting mechanism to maintain the belt in the desired lateral position on the pulleys. The exercise treadmill also includes a lift mechanism with an internally threaded sleeve engaged to vertically aligned nonrotating screws. A user display of foot impact force on the belt is also provided.

SUMMARY

This Summary is provided to introduce a selection of concepts that are further described herein below in the Detailed Description. This Summary is not intended to identify key or central features from the claimed subject matter, nor is it intended to be used as an aid in limiting the scope of the claimed subject matter.

In certain examples, a shared workstation includes a frame, a first treadmill, a second treadmill, and a shared work surface. The first treadmill is adjacent to the frame and has a first tread surface that extends along a first centerline. The second treadmill is adjacent to the frame and has a second tread surface that extends along a second centerline. The first and second centerlines are transversely oriented to each other at an angle. The shared work surface is supported by the frame, and the shared work surface is located above the first and second treadmills such that users walking on the first and second tread surfaces can share work with each other on the shared work surface.

In certain examples, a shared workstation includes a frame, a first treadmill, a second treadmill, a first shared work surface, and a second shared work surface. The first treadmill is adjacent to the frame and has a first tread surface that extends along a first centerline. The second treadmill is adjacent to the frame and has a second tread surface that extends along a second centerline. The first and second centerlines are transversely oriented to each other at an angle. The first treadmill includes a front and a rear, and the second treadmill includes a front and a rear. The fronts of the first and second treadmills are located adjacent to each other and the rears of the first and second treadmills are spaced apart from each other relative to the fronts of the first and second treadmills. The first shared work surface is supported by the frame and located above the fronts of the first and second treadmills so that users walking on the first and second tread surfaces can share work with each other on the first shared work surface. The frame includes a support column that extends upwardly with respect to the first and second treadmills. The support column is located closer to the fronts of the first and second treadmills than the rears of the first and second treadmills and supports the shared work surface above the fronts of the first and second treadmills. The second shared work surface is supported by the frame and is located between the first and second treadmills. The second shared work surface is located above the first and second treadmills so that users walking on the first and second tread surfaces can share work with each other on the second shared work surface.

In certain examples, a shared workstation is configured for use with a first exercise apparatus and a second exercise apparatus. The first exercise apparatus has a front, a rear, and a first centerline. Similarly, the second exercise apparatus has a front, a rear, and a second centerline. The shared workstation includes a frame having a support column that extends upwardly with respect to the first and second exercise apparatuses. The support column is located closer to the fronts of the first and second exercise apparatuses than the rears of the first and second exercise apparatuses. The support column has a cover with a first front surface and a second front surface transversely oriented to at an obtuse angle with respect to each other. The front of the first exercise apparatus is positioned adjacent to the first front surface and the front of the second exercise apparatus is positioned adjacent to the second front surface such that the first and second centerlines of the first and second exercise apparatuses are transversely oriented to each other at an acute angle which is supplementary with the obtuse angle. The shared workstation includes a shared work surface supported by the frame and extending horizontally with respect to the frame. The shared work surface is located above the fronts of the first and second exercise apparatuses so that users operating the exercise apparatuses can share work with each other on the shared work surface.

BRIEF DESCRIPTION OF THE DRAWINGS

Examples of workstation apparatuses including converging treadmills are described with reference to the following drawing FIGURES. The same numbers are used through the FIGURES to reference like features and components.

DETAILED DESCRIPTION

Figure 1:
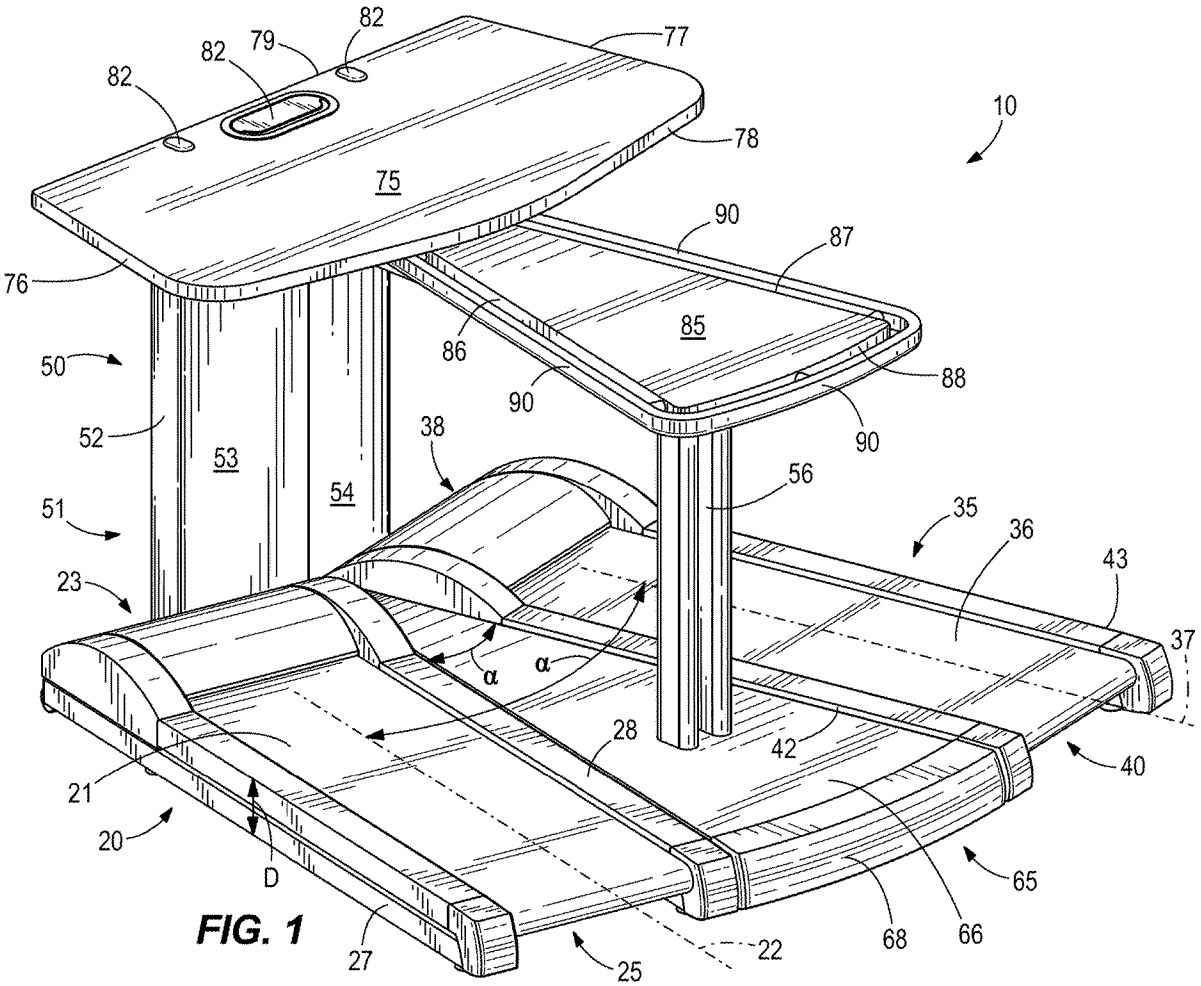
FIG. 1 is an example workstation.

Work spaces, especially office spaces, often contain several desks or workstations for employees to use during the workday. However, some workstations do not encourage employee collaboration. Research has shown that collaboration, sharing of ideas, physical activity, and/or other person-to-person interactions increases employee productivity in the workplace. Accordingly, collaborative workstations are advantageous for many employers. The inventors have combined workstations, such as standing desks, with exercise apparatus, such as treadmills, bikes, or ellipticals. The inventors have discovered that orientating workstation work surfaces and/or exercise equipment at converging or acute angles with respect to each other increases interaction, eye contact, collaboration, sharing of ideas, and work product quality. Other office components, such as storage spaces, shelving, cabinets, racks and the like, of typical work spaces may also be orientated at converging or acute angles to employees.

The present disclosure includes examples of workstation apparatuses that include exercise apparatuses, specifically shared workstations that include converging treadmills. In one example, the workstation includes a pair of treadmills positioned about a frame such that the centerlines of each treadmill are transversely orientated to each other at an acute angle. Shared work surfaces located above the treadmills allow users using the workstation to share work with each other on the shared work surfaces.

Referring to FIGS. 1-8, an example shared workstation 10 for use by one or more users is depicted. The workstation 10 includes a first treadmill 20 having a first tread surface 21 that extends along a first centerline 22, a front 23, a rear 25, a front surface 24, a left surface 27, and a right surface 28. Similarly, the second treadmill 35 includes a second tread surface 36 that extends along a second centerline 37, a front 38, a rear 40, a front surface 39, a left surface 42, and a right surface 43. The treadmills 20, 35 are positioned adjacent to or abut a frame 50 (to be described further herein below), and the treadmills 20, 35 are detachable and/or removable from the workstation 10 such that the workstation 10 can be utilized as a standing or sitting workstation without exercise apparatuses. Different types of exercise apparatuses, such as stationary bikes or ellipticals, can be interchanged with the treadmills 20, 35.

Figure 6:
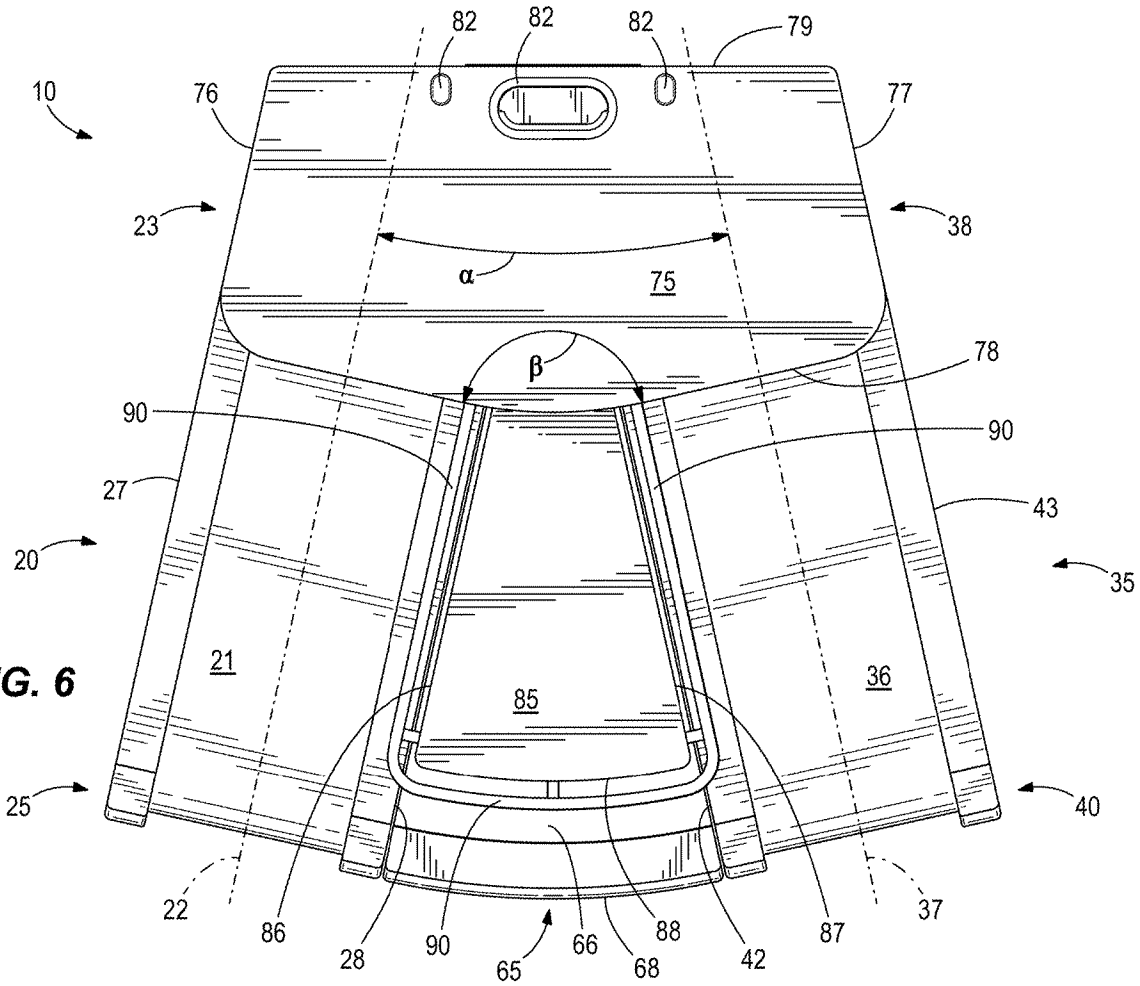
FIG. 6 is a top view of the workstation depicted in FIG. 1.
Figure 7:
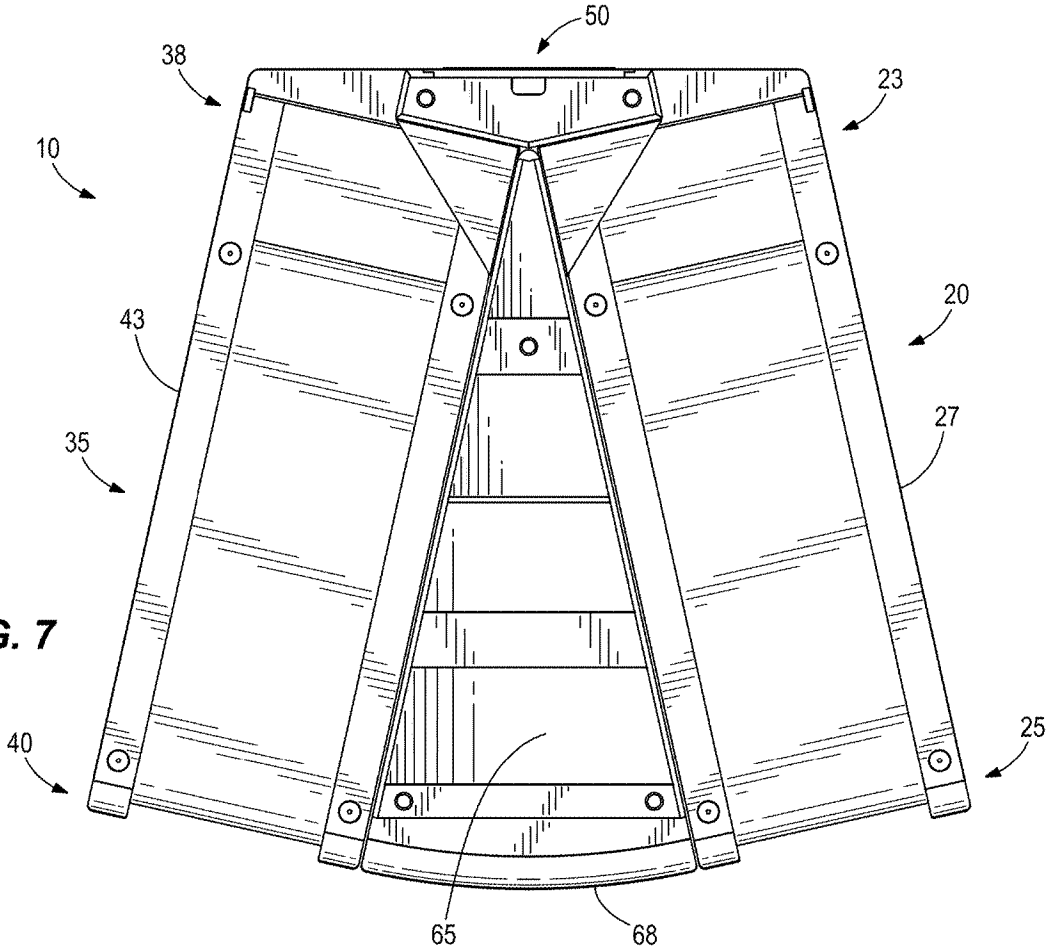
FIG. 7 is a bottom view of the workstation depicted in FIG. 1.

The first centerline 22 of the first treadmill 20 and the second centerline 37 of the second treadmill 35 are transversely oriented to each other at an angle $\alpha$. (FIGS. 1 and 6). The first centerline 22 and the second centerline 37 are transversely orientated to each other such that the fronts 23, 38 are located adjacent to each other and the rears 25, 40 are spaced apart from each other relative to the fronts 23, 38. (FIGS. 1 and 6). The angle $\alpha$ can be defined by a relative relationship between the fronts 23, 38 and rears 25, 40. The angle $\alpha$ can also be defined by the right surface 28 of the first treadmill 20 and the left surface 27 of the left treadmill 35 (FIG. 1). In some examples, the angle $\alpha$ is an acute angle. In some examples, the angle $\alpha$ is in the range of 15-35 degrees.

Figure 2:
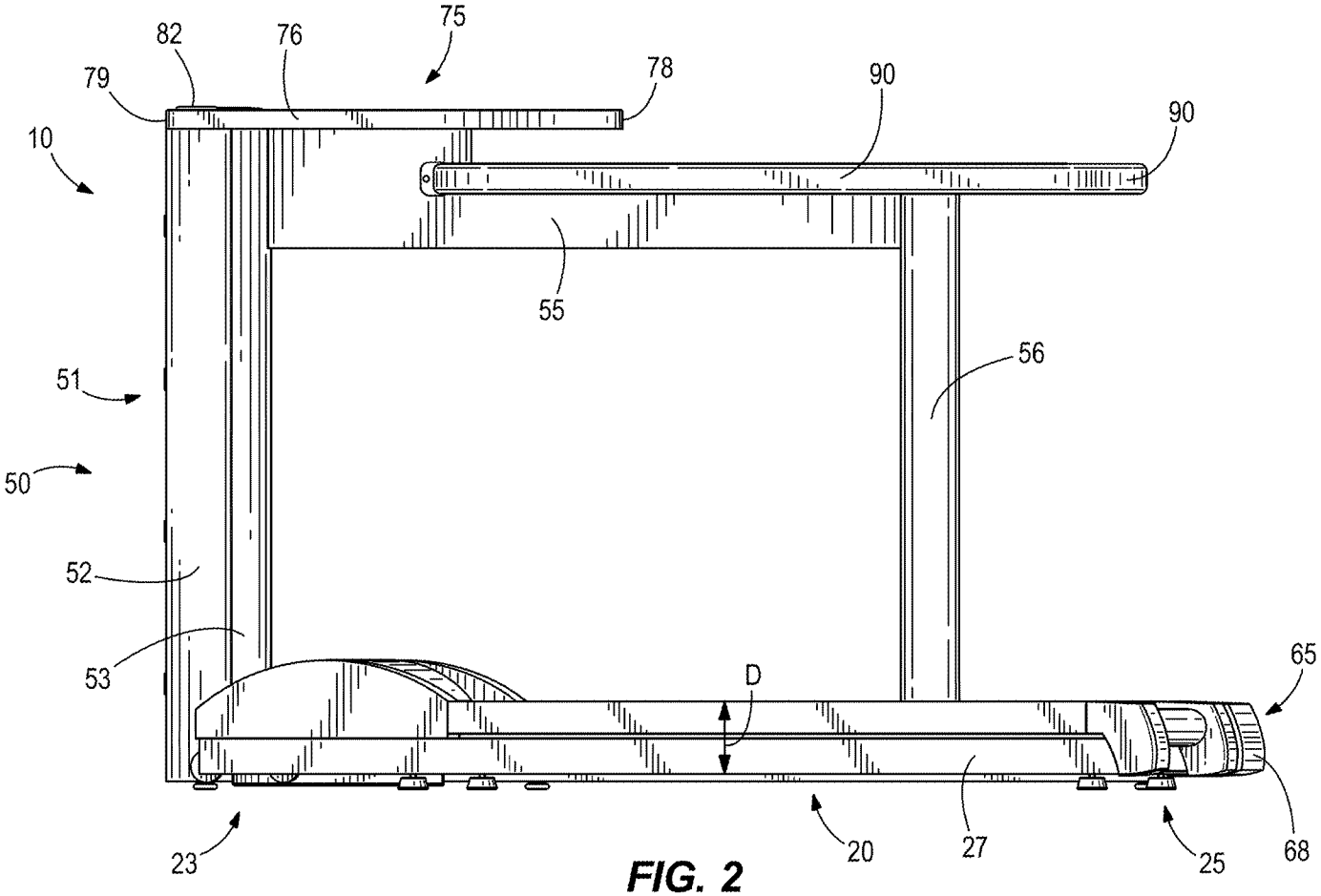
FIG. 2 is a left side view of the workstation depicted in FIG. 1.
Figure 3:
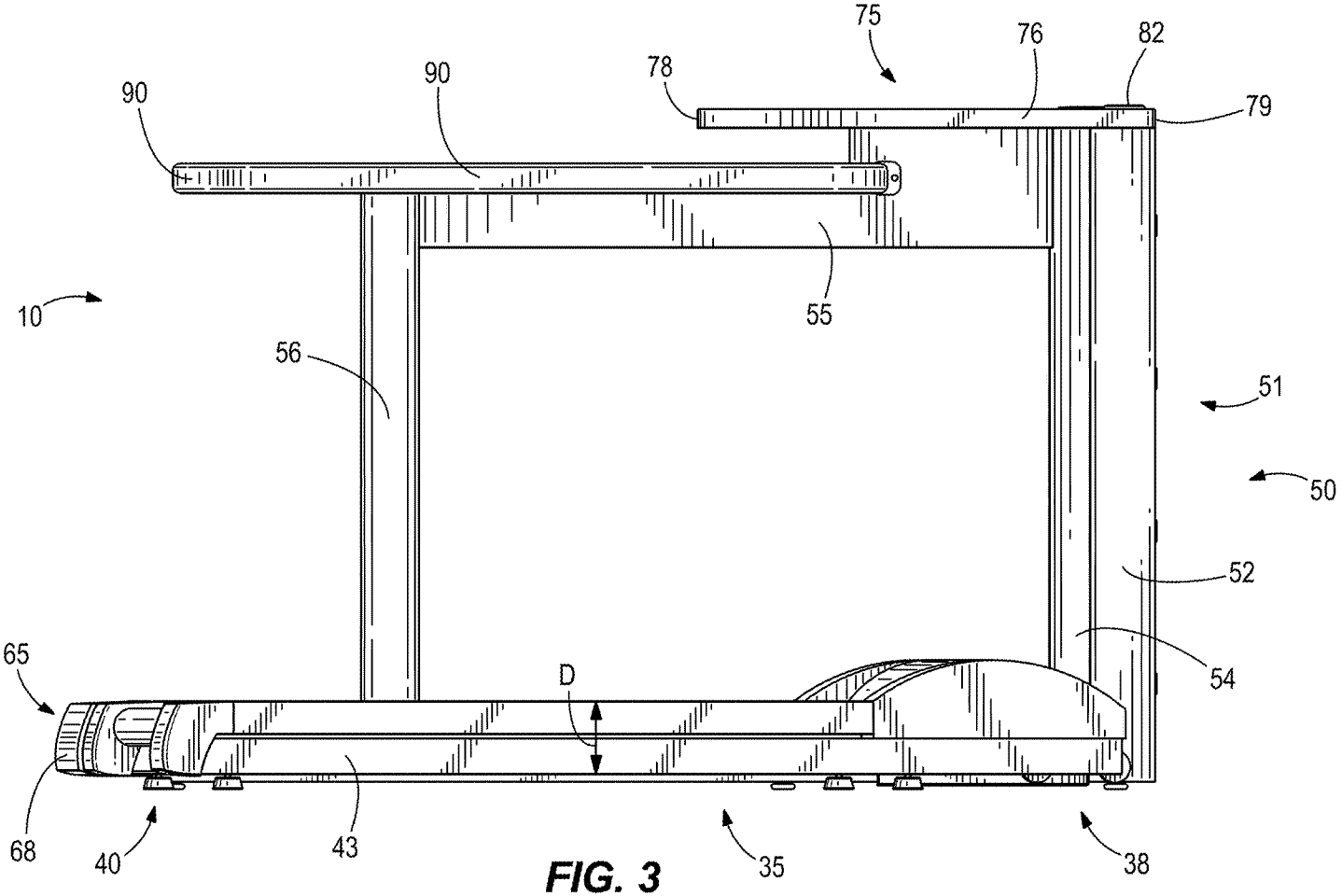
FIG. 3 is a right side view of the workstation depicted in FIG. 1.
Figure 4:
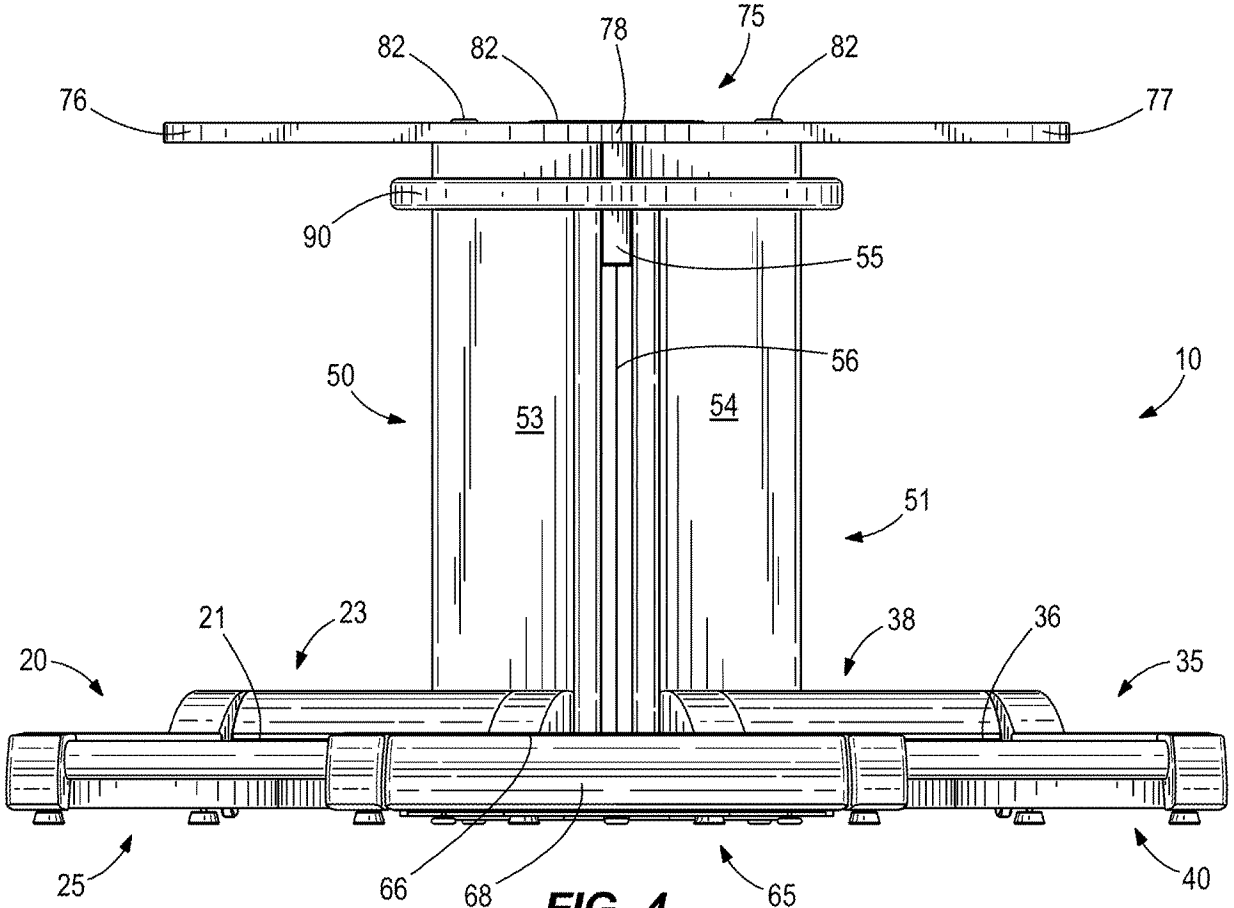
FIG. 4 is a rear view of the workstation depicted in FIG. 1.
Figure 5:
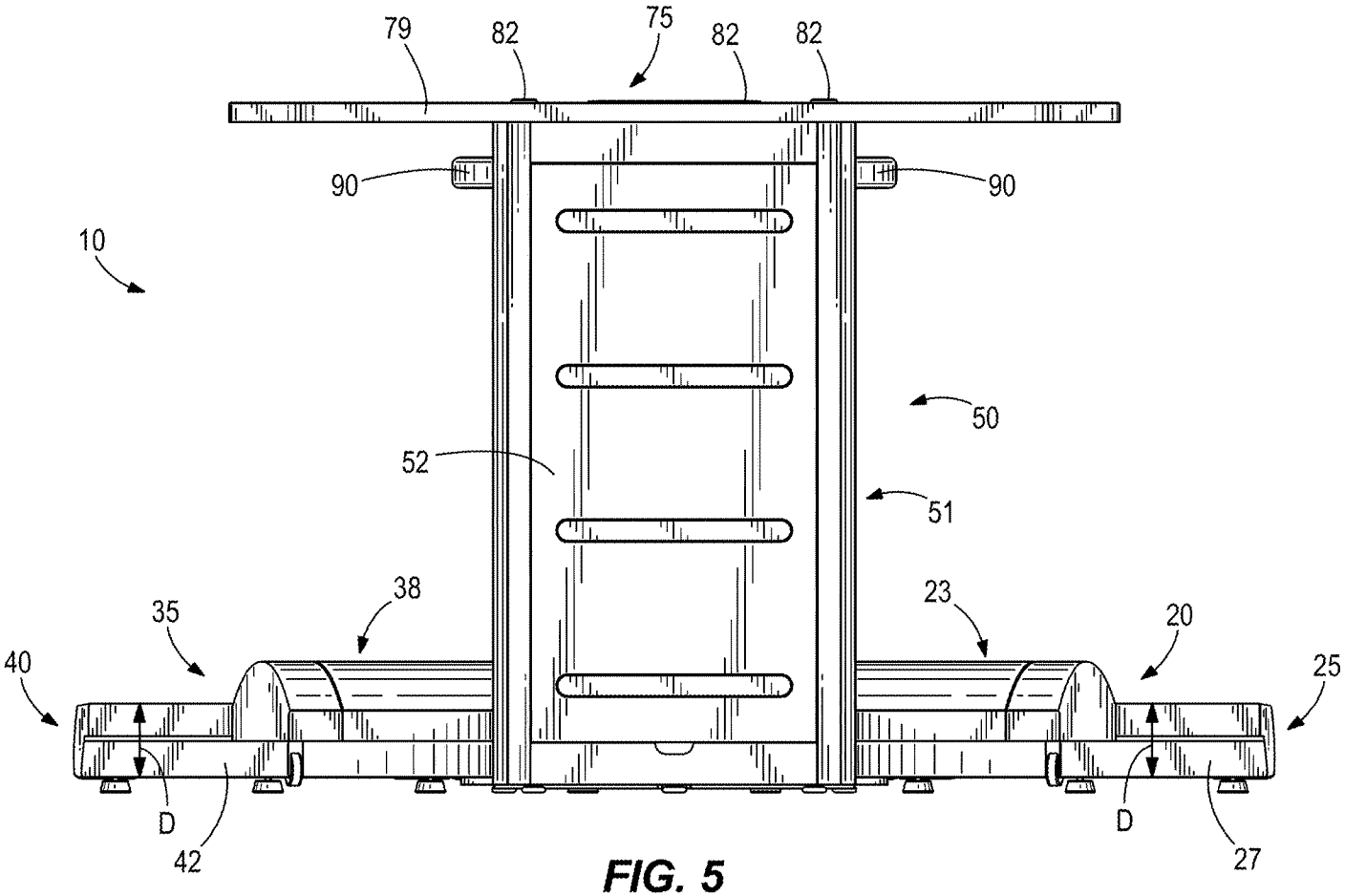
FIG. 5 is a front view of the workstation depicted in FIG. 1.

The first treadmill 20 and the second treadmill 35 are supported on a horizontal support surface (not shown) (e.g. an office floor) such that the first tread surface 21 and the second tread surface 36 are elevated above the horizontal support surface by a distance D (FIGS. 1-3). The treadmills 20, 35 define a separation space (not shown) between the right surface 28 of the first treadmill 20 and the left surface 42 of the second treadmill 35. The separation space can be filled with a filler panel 65 such that the filler panel 65 prevents objects from falling between the treadmills 20, 35 (FIGS. 1, 4, and 6). The filler panel 65 can provide a footrest for the users of the workstation 10. The filler panel 65 has a top surface 66, a front surface (not shown), and a rear surface 68 (FIG. 1).

The frame 50 includes a support column 51 and a second support column 56 that extend upwardly from the horizontal support surface and with respect to the treadmills 20, 35. The support column 51 can be located closer to the fronts 23, 38 than the rears 25, 40 of the treadmills 20, 35. The support column 51 and/or the second support column 56 are located between the treadmills 20, 35, and the support column 51 is coupled to the second support column 56 by a support brace 55 (FIG. 2). The support column 51 and/or second support column 56 can extend from the filler panel 65.

Figure 8:
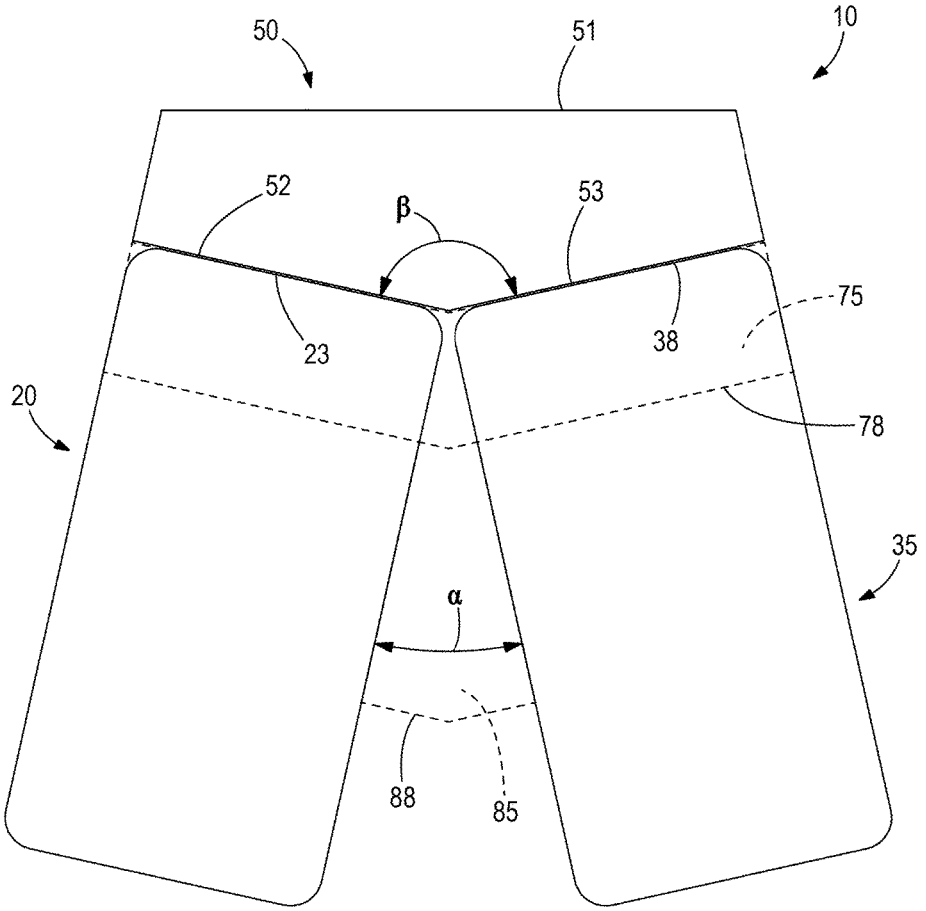
FIG. 8 is a top view of the workstation depicted in FIG. 1 with work surfaces shown in dashed lines.

The support column 51 includes a cover 52 which defines an interior space for electrical wires and other components of the workstation 10. The cover 52 has a first front surface 53 and a second front surface 54. The first front surface 53 is adjacent to and/or abuts the front surface 24 of the first treadmill 20 and the second front surface 54 is adjacent to and/or abuts the front surface 24 and the front surface 39 of the second treadmill 35. The first front surface 53 and the second front surface 54 are transversely oriented to each other at an obtuse angle $\beta$ such that the obtuse angle $\beta$ and the angle $\alpha$ are supplementary angles with each other (FIG. 8). The frame 50 is vertically adjustable such that the user can change the height of the work surfaces (to be discussed further herein) between a standing desk height and a sitting desk height and therebetween.

The frame 50 supports a shared work surface 75 above the treadmills 20, 35 such that the users using the workstation 10 and/or walking on the tread surfaces 21, 36 can interact, collaborate, and share work with each other on the shared work surface 75. The shared work surface 75 is located at least partially over the treadmills 20, 35 and/or first and second tread surfaces 21, 36 of the treadmills 20, 35. The shared work surface 75 extends horizontally with respect to the frame 50, and the shared work surface 75 extends parallel or perpendicular with the first centerline 22 and/or second centerline 37. The shared work surface 75 includes a first side 76, second side 77, front side 78, and back side 79. The first side 76 and the second side 77 extend with respect to each other at the acute angle $\alpha$ (FIG. 6). The front side 78 is orientated at the obtuse angle $\beta$ (FIGS. 6 and 8). Handles 90 can be coupled to any side 76, 77, 78, 79 of the shared work surface 75 such that the user can grasp the handles 90 while using the workstation 10. The shared work surface 75 can include grommet holes 82 for computer equipment and wires. Control panels (not shown) for operating the treadmills 20, 35 are connected to the shared work surface 75 such that the user can control the speed and/or elevation of the tread surfaces 21, 36. The shared work surface 75 can take any shape and size. The shared work surface 75 can be planar and include straight and/or rounded edges. The shared work surface 75 is constructed out of any suitable material including wood, particle board, laminated wood, metal, and/or the like. The shared work surface 75 can be monolithic or comprised of several planer pieces.

The frame 50 supports a second shared work surface 85 above the treadmills 20, 35. The second shared work surface 85 is located above the treadmills 20, 35 such that users using the workstation 10 and/or walking on the first tread surface 21 and/or the second tread surface 36 can share work with each other on the second shared work surface 85. The second shared work surface 85 includes a first side 86 and a second side 87 that extend with respect to each other at the angle α (FIG. 6), and the second shared work surface 85 has a back side 88. The handles 90 can be coupled to the first side 86 and/or second side 87 such that the user can grasp the handles 90 when using the workstation 10.

In the present disclosure, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

The invention claimed is:

1. A shared workstation, comprising:

a frame;

a first treadmill connected to the frame, the first treadmill having a first tread surface that extends along a first centerline;

a second treadmill connected to the frame, the second treadmill having a second tread surface that extends along a second centerline;

wherein the first and second centerlines are transversely oriented to each other at an angle; and a shared work surface supported by the frame, wherein the shared work surface is located above the first and second treadmills so that users walking on the first and second tread surfaces can share work with each other on the shared work surface.

2. The shared workstation according to claim 1, wherein the first treadmill comprises a front and a rear and wherein the second treadmill comprises a front and a rear; and wherein the fronts of the first and second treadmills are located adjacent to each other and wherein the rears of the first and second treadmills are spaced apart from each other relative to the fronts of the first and second treadmills.

3. The shared workstation according to claim 2, wherein the shared work surface extends horizontally with respect to the frame.

4. The shared workstation according to claim 3, wherein the shared work surface comprises opposite sides that extend with respect to each other at the angle.

5. The shared workstation according to claim 4, wherein the frame comprises a support column that extends upwardly with respect to the first and second treadmills, wherein the support column is located closer to the fronts of the first and second treadmills than the backs of the first and second treadmills and wherein the support column supports the shared work surface above the fronts of the first and second treadmills.

6. The shared workstation according to claim 5, wherein the support column is located between the first and second treadmills.

7. A shared workstation, comprising:

a frame;

a first exercise device adjacent connected to the frame, the first exercise device extending along a first centerline;

a second exercise device adjacent connected to the frame, the second exercise device extending along a second centerline;

wherein the first and second centerlines are transversely oriented to each other at an angle; and a shared work surface supported by the frame, wherein the shared work surface is located above the first and second exercise devices so that users on the first and second exercise devices can share work with each other on the shared work surface;

wherein the first exercise device comprises a front and a rear and wherein the second exercise device comprises a front and a rear; and wherein the fronts of the first and second exercise devices are located adjacent to each other and wherein the rears of the first and second exercise devices are spaced apart from each other relative to the fronts of the first and second exercise devices;

wherein the shared work surface extends horizontally with respect to the frame;

wherein the shared work surface comprises opposite sides that extend with respect to each other at the angle;

wherein the frame comprises a support column that extends upwardly with respect to the first and second exercise devices, wherein the support column is located closer to the fronts of the first and second exercise devices than the backs of the first and second exercise devices and wherein the support column supports the shared work surface above the fronts of the first and second exercise devices; and a second shared work surface supported by the frame, wherein the second shared work surface is located above the first and second exercise devices so that users on the first and second exercise devices can share work with each other on the second shared work surface.

8. The shared workstation according to claim 7, wherein the second shared work surface comprises opposite sides that extend with respect to each other at the angle.

9. The shared workstation according to claim 8, wherein the frame further comprises a second support column that extends upwardly with respect to the first and second exercise devices; wherein the second support column is located between the first and second exercise devices and wherein the second support column supports the second shared work surface above the first and second exercise devices.

10. A shared workstation, comprising:

a frame;

a first exercise device adjacent connected to the frame, the first exercise devices extending along a first centerline;

a second exercise device adjacent connected to the frame, the second exercise device extending along a second centerline;

wherein the first and second centerlines are transversely oriented to each other at an angle; and a shared work surface supported by the frame, wherein the shared work surface is located above the first and second exercise devices so that users on the first and second exercise devices can share work with each other on the shared work surface;

wherein the first exercise device comprises a front and a rear and wherein the second exercise device comprises a front and a rear; and wherein the fronts of the first and second exercise devices are located adjacent to each other and wherein the rears of the first and second exercise devices are spaced apart from each other relative to the fronts of the first and second exercise devices;

wherein the shared work surface extends horizontally with respect to the frame;

wherein the shared work surface comprises opposite sides that extend with respect to each other at the angle;

wherein the frame comprises a support column that extends upwardly with respect to the first and second exercise devices, wherein the support column is located closer to the fronts of the first and second exercise devices than the backs of the first and second exercise devices and wherein the support column supports the shared work surface above the fronts of the first and second exercise devices;

wherein the support column is located between the first and exercise devices; and wherein the support column comprises a cover having a first front surface and a second front surface, wherein the first front surface abuts the front of the first exercise device and the second front surface abuts the front of the second exercise device and wherein the first front surface and the second front surface are transversely oriented to each other at an obtuse angle whereby the obtuse angle and the angle are supplementary angles to each other.

11. The shared workstation according to claim 10, wherein the cover defines an interior space for electrical wires to be located therein.

12. The shared workstation according to claim 4, further comprising handles coupled to the opposite sides of the shared work surface whereby the users grasps the handles while using the shared workstation.

13. The shared workstation according to claim 1, wherein the angle is an acute angle.

* * * * *